US010871079B2

(12) United States Patent
Delaporte et al.

(10) Patent No.: US 10,871,079 B2
(45) Date of Patent: Dec. 22, 2020

(54) TURBINE SEALING ASSEMBLY FOR TURBOMACHINERY

(71) Applicant: SAFRAN AIRCRAFT ENGINES, Paris (FR)

(72) Inventors: Nicolas Daniel Delaporte, Moissy-Cramayel (FR); Anthony Pierre Beguin, Moissy-Cramayel (FR); Didier Noël Durand, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 132 days.

(21) Appl. No.: 16/138,062

(22) Filed: Sep. 21, 2018

(65) Prior Publication Data

US 2019/0085713 A1 Mar. 21, 2019

(30) Foreign Application Priority Data

Sep. 21, 2017 (FR) ..... 17 58743

(51) Int. Cl.
*F01D 11/12* (2006.01)
*F01D 11/00* (2006.01)
*F01D 25/24* (2006.01)

(52) U.S. Cl.
CPC ..... *F01D 11/122* (2013.01); *F01D 11/005* (2013.01); *F01D 25/246* (2013.01); *F05D 2240/55* (2013.01); *F05D 2260/30* (2013.01)

(58) Field of Classification Search
CPC ..... F01D 25/24; F01D 25/246; F01D 11/005; F01D 11/08; F01D 11/122; F01D 9/04; F05D 2240/55; F16J 15/00; F16J 15/02
See application file for complete search history.

(56) References Cited

U.S. PATENT DOCUMENTS 4,311,432 A * 1/1982 Kildea ..... F01D 11/08 415/134
5,333,995 A * 8/1994 Jacobs ..... F01D 5/3092 415/173.1

(Continued)

FOREIGN PATENT DOCUMENTS

EP 1642006 A1 4/2006
FR 3033827 9/2016

(Continued)

OTHER PUBLICATIONS

French Application No. 1758743, Search Report and Written Opinion dated Jun. 18, 2018, 7 pgs. (in French, relevance found in citations).

*Primary Examiner* — Nathaniel E Wiehe
*Assistant Examiner* — Jackson N Gillenwaters
(74) *Attorney, Agent, or Firm* — Lathrop GPM LLP

(57) ABSTRACT

The invention relates to a sealing assembly for a turbine engine, comprising a wheel mounted inside a sectorised ring carrying an abradable material, having at an axial end an annular groove (14) in which a circumferential rail of the casing is engaged, sealing members being partly engaged in a recess (19) of a circumferential edge of a ring sector and another part thereof being engaged in a recess of a circumferential edge circumferentially opposite a circumferentially adjacent ring sector, characterised in that each sealing member comprises an axial end portion (180*a*) arranged radially between the circumferential rail and two adjacent ring sectors.

19 Claims, 5 Drawing Sheets

(56) References Cited

U.S. PATENT DOCUMENTS

| | | | | |
|---|---|---|---|---|
| 5,971,703 | A * | 10/1999 | Bouchard | F01D 25/246 415/135 |
| 6,340,285 | B1 * | 1/2002 | Gonyou | F01D 11/005 415/116 |
| 6,341,938 | B1 * | 1/2002 | Zegarski | F01D 11/127 415/173.4 |
| 7,377,742 | B2 * | 5/2008 | Shapiro | F01D 11/08 415/108 |
| 7,387,488 | B2 * | 6/2008 | Nichols | F01D 5/288 415/116 |
| 8,961,117 | B2 * | 2/2015 | Garin | F01D 11/005 415/177 |
| 9,238,977 | B2 * | 1/2016 | Albers | F01D 11/127 |
| 9,353,649 | B2 | 5/2016 | Rioux | |

FOREIGN PATENT DOCUMENTS

| | | | | |
|---|---|---|---|---|
| FR | 3033827 | B1 * | 8/2019 | F01D 11/005 |
| WO | WO 2005/003518 | A1 | 1/2005 | |
| WO | WO 2013/139837 | A1 | 9/2013 | |

* cited by examiner

TURBINE SEALING ASSEMBLY FOR TURBOMACHINERY

CROSS-REFERENCE TO RELATED APPLICATION

This application claims priority to French Patent Application No. 1758743, filed Sep. 21, 2017, which is incorporated herein by reference.

SUMMARY OF THE INVENTION

The present invention relates to the field of turbines for turbomachinery. It relates more specifically to a turbine stage for a turbine engine, such as an aircraft turbofan or a turboprop engine.

A turbine engine, specifically a twin-spool turbine engine, conventionally includes, in the downstream direction, a fan, a low pressure compressor, a high pressure compressor, a combustion chamber, a high pressure turbine and a low pressure turbine.

Conventionally, in the present application, "upstream" and "downstream" are defined relative to the direction of the air flow in the turbine engine. Conventionally, in the present application, "internal" and "external", "lower" and "higher" and "internal" and "external" are similarly defined radially relative to the axis of the turbine engine.

Conventionally and as illustrated in FIG. 1, a turbine generally comprises several stages each having a guide vane hooked radially outwards on an external casing of the turbine and a blade wheel mounted downstream from the guide vane rotating radially inside a sectorised ring also hooked to the external casing. The sectorised ring is formed of several sectors that are arranged circumferentially from end to end and are borne by the turbine casing. The ring sectors each carry internally a block of abradable material, with these blocks jointly defining a ring of abradable material frictionally interacting with annular lips borne by the blade wheel.

The guide vane comprises two internal and external coaxial annular platforms extending one inside the other and interconnected by substantially radial blades. The external annular platform comprises two annular lugs, upstream and downstream respectively, extending radially outwards. The upstream annular lug of the guide vane is axially engaged from the downstream direction on a cylindrical rail of the casing so as to bear radially inwards on the latter. The turbine wheel is formed of a rotor disc bearing substantially radial blades on its periphery.

The upstream end of each ring section comprises a C-section circumferential member which is axially engaged from the downstream direction on an upstream annular rail of the external casing and on a downstream annular lug of the external platform of the guide vane arranged upstream. The downstream end of each ring sector comprises an annular groove sector open radially outwards. Thus, when the ring sectors are arranged circumferentially end to end, the groove portions of each ring sector jointly define an annular groove in which a downstream annular rail of the external casing is engaged.

As can be seen in FIG. 1, each ring sector comprises a frustoconical wall sector extended downwards by a cylindrical wall sector, one external face of which forms a bottom wall of the annular groove sector of said sector. The annular groove sector of each ring sector is thus delimited by a downstream face of the frustoconical wall sector, an external face of the cylindrical wall sector and a radial annular rim sector borne by the cylindrical wall sector.

In order to provide sealing at the circumferential junction of each ring sector, mounting a sealing member is known, formed by a flat plate substantially rectangular in section, half in a recess of a circumferential edge of a ring sector and half in a recess of a circumferential edge circumferentially opposite a circumferentially adjacent ring sector. More specifically, the recess is formed in a frustoconical wall sector of a ring sector, with the upstream end of the recess opening in the downstream face of the annular groove sector so as to allow installation of the sealing plate from the downstream direction. Such an arrangement of sealing plates at the junction between the ring sectors is known in particular from the Applicant's document FR3033827.

During operation, frictions have been observed between the downstream ends of the sealing plates and the downstream rail of the external casing, resulting in wear of the respective parts in contact with one another. These frictions are caused by vibratory phenomena linked to the high thermal activity in the area in question when the turbine engine is operating. The worn areas of the casing rails cannot furthermore be repaired, which considerably shortens the service life of the external casing and increases the cost of operating the turbine engine.

For this purpose, a solution is offered that simultaneously ensures a permanent radial seal between the turbine rings and limits wear on the sealing plates and rails of the casing.

To this end, the invention relates to a sealing assembly for a turbine engine, comprising a first and second adjacent ring sector in the circumferential direction configured to carry an abradable material, wherein the axial ends of each first and second ring sectors comprise a groove in which a circumferential part of casing is engaged, with a sealing member being partly engaged in a recess of the first ring sector and another part thereof being engaged in a recess of the second ring sector, the recess and groove of the first ring sector being respectively arranged circumferentially opposite the recess and the groove of the second ring sector, characterised in that the sealing member comprises an axial end portion arranged radially between the circumferential portion of the casing and the respective grooves of the first and second ring sectors. This configuration not only allows an increase in the degree of sealing between the ring sectors and the circumferential portion of the casing, but also elimination of the frictions between the sealing member and the circumferential portion of the casing, since the sealing member is interposed between the circumferential portion of the casing and the adjacent first and second ring sectors. It should be noted that the circumferential portion of the casing may be an annular rail serving to lock the ring on the casing by means of a C-shaped member for instance.

The axial end portion of the sealing member may be elastically stressed between the circumferential casing portion and the adjacent first and second ring sectors.

This stress advantageously allows reduction in play between the circumferential portion of the casing and the first and second ring sectors, which allows an even greater reduction in the vibrations and wear in this area.

According to another characteristic, the recess of each of the first and second ring sectors is formed by a slot opening axially, respectively, in the groove of the first and second ring sectors.

This facilitates installation of the plate in the recess.

The groove of each of the first and second ring sectors may comprise a bottom wall, the circumferential end portions of which each comprise a depression, these depressions being circumferentially opposite each other and jointly defining an area for receiving said axial end portion of a sealing member.

The sealing member is formed by a plate, said axial end portion of which is curved in the circumferential direction such that its radially internal face is concave.

Consequently, contact between the circumferential portion of the casing and the sealing member is homogeneous. This new type of contact between the circumferential portion of the casing and the plate is more stable than that of the prior art, thereby making the circumferential portion of casing reparable by known machining methods.

Preferably, the sealing member has a thickness or radial dimension smaller than the radial dimension of the receiving area.

Secondly, a turbine is proposed, comprising a stage as described above.

Finally, a turbine engine, such as a turboprop engine or a turbojet engine, comprising such a turbine is proposed.

The invention will be better understood and other details, characteristics, and advantages of the invention will appear on reading the following description given by way of non-limiting example and with reference to the accompanying drawings, in which:

DETAILED DESCRIPTION

Figure 1:
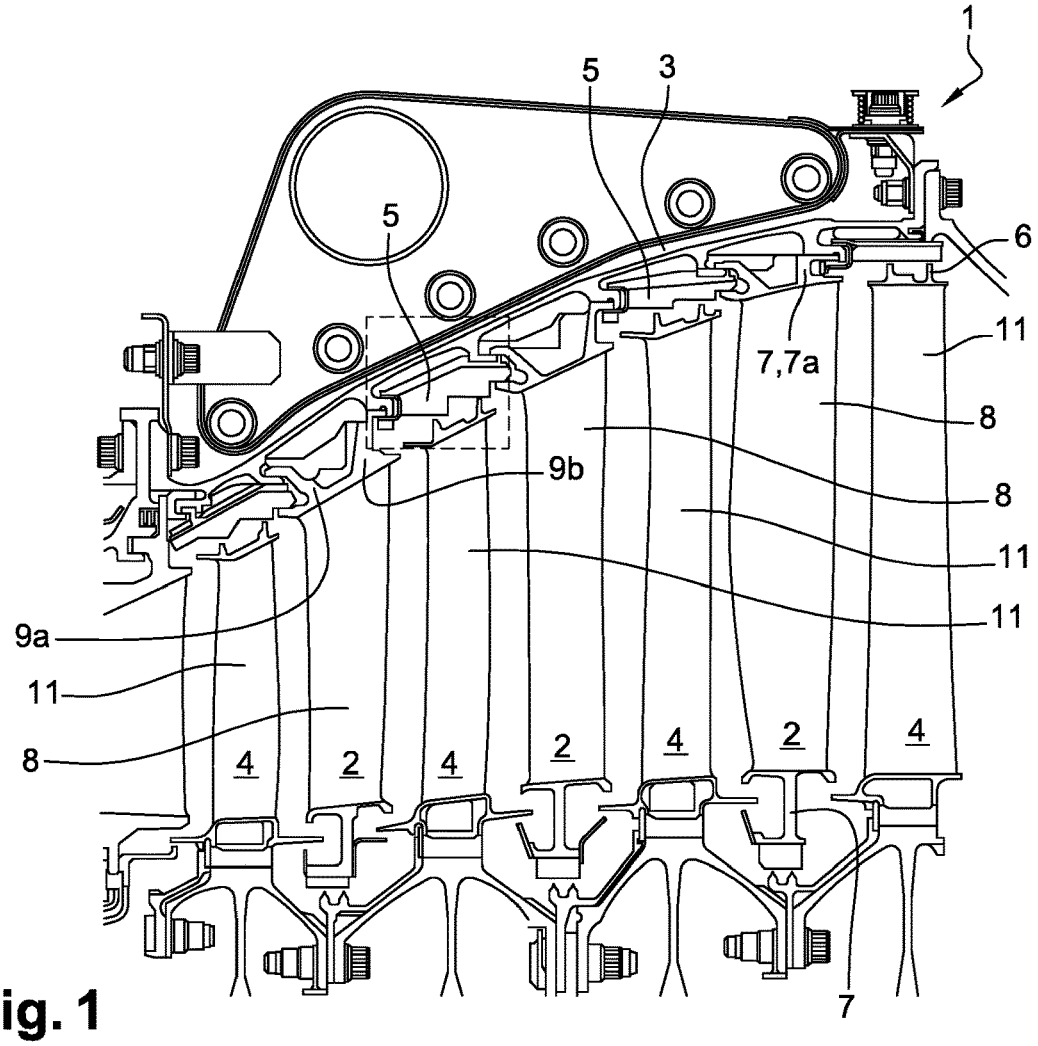
FIG. 1 is a sectional view of a low pressure turbine according to the known technique.
Figure 2:
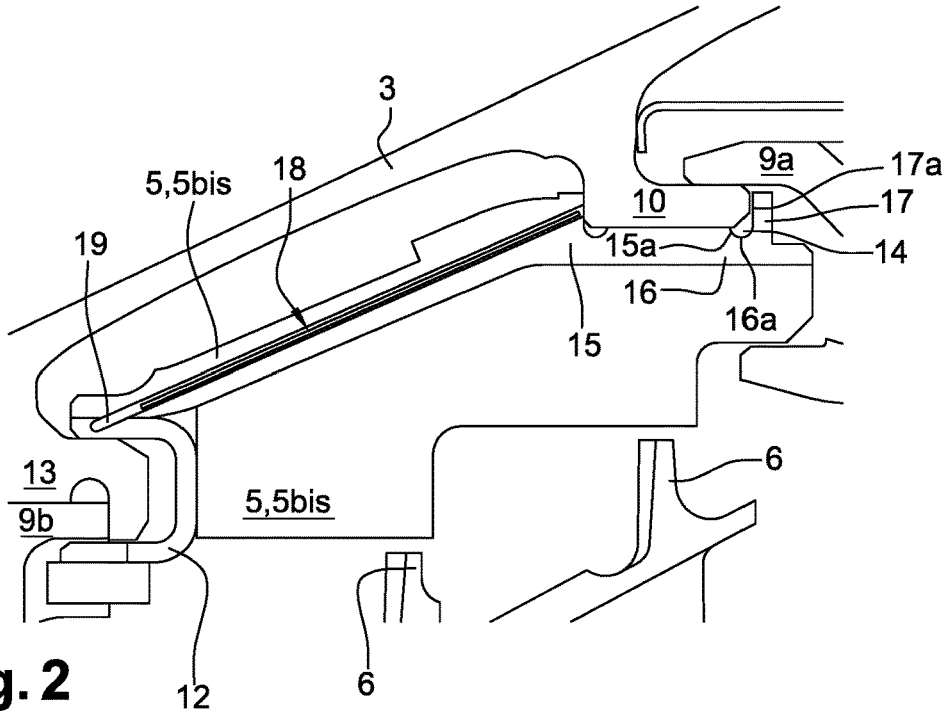
FIG. 2 is a diagrammatic view of the area enclosed in dotted lines in FIG. 1.

FIG. 1 illustrates a turbine engine low pressure turbine 1 comprising several stages each having a guide vane 2 hooked radially outwards on an external casing 3 of the turbine and a blade wheel 4 mounted downstream from the guide vane 2 rotating radially inside a sectorised ring 5 also hooked to the external casing 3. The turbine wheel 4 is formed of a rotor disc bearing substantially radial blades 11 on its periphery. The sectorised ring 5 is formed of several sectors 5*bis*, as illustrated in FIG. 2, which are arranged circumferentially from end to end and are borne by the casing 3 of the turbine 1. The ring sectors 5*bis* each carry internally a block of abradable material, with these blocks jointly defining a ring of abradable material frictionally interacting with annular lips 6 borne by the blade wheel 4.

Each guide vane comprises two radially internal and radially external annular platforms 7 extending one inside the other and interconnected by substantially radial blades 8 spaced at regular intervals circumferentially. The external annular platform 7*a* comprises two annular lugs 9*a* and 9*b*, upstream and downstream respectively, extending radially outwards. The upstream annular lug 9*a* of the guide vane 2 is axially engaged from the downstream direction on a cylindrical rail 10 of the casing 3 so as to bear radially inwards on the latter.

Reference will now be made to FIG. 2 illustrating a ring sector 5*bis* according to the prior art. The upstream end of the latter comprises a C-section circumferential member 12 which is axially engaged from the downstream direction on an upstream annular rail 13 of the external casing 3 and on a downstream annular lug 9*b* of the external platform 7*a* of the guide vane 2 arranged upstream. The downstream end of the ring sector 5*bis* comprises an annular groove sector 14 open radially outwards.

Thus, when two ring sectors 5*bis* are arranged circumferentially end to end, the groove portions of each ring sector 5*bis* jointly define an annular groove 14 in which a downstream annular rail 10 of the external casing 3 is engaged.

As illustrated in FIG. 2, each ring sector 5*bis* comprises a frustoconical wall sector 15 extended downwards by a cylindrical wall sector 16 jointly bearing an abradable material sector 17. Each groove sector 14 is delimited by an external face 16*a* of the cylindrical wall sector 16 which forms a bottom surface of the annular groove sector 14 of said sector and by a downstream end face 15*a* of the frustoconical wall sector 15 and an upstream face 17*a* of an annular rim sector 17 borne by the cylindrical wall sector 16.

Figure 3:
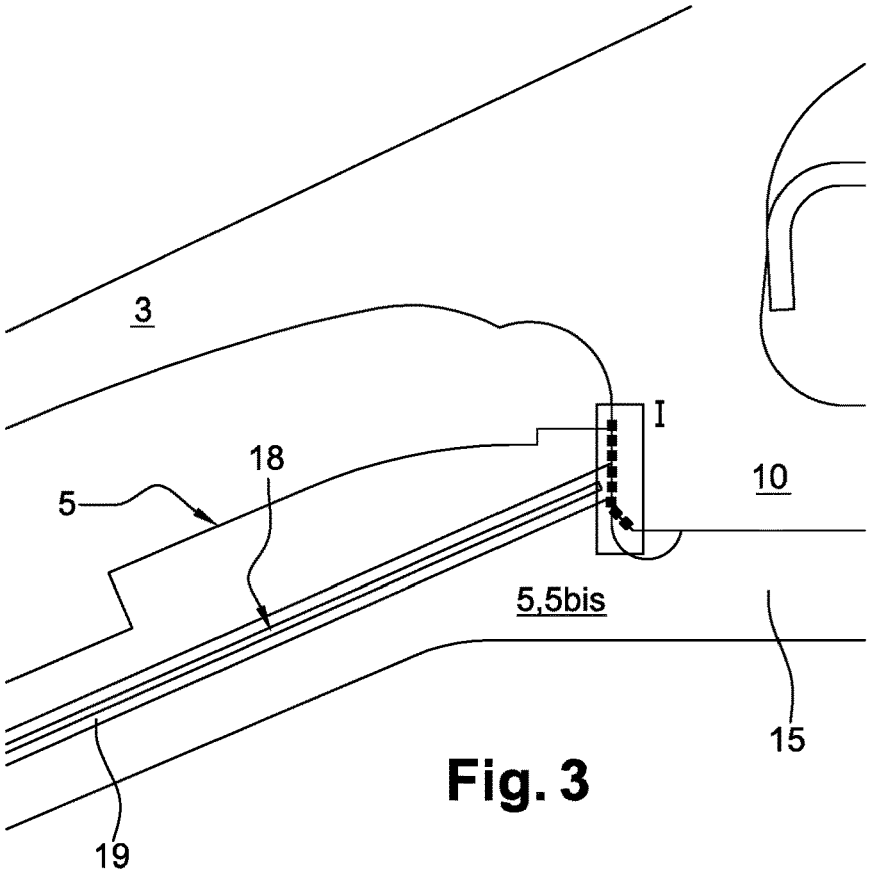
FIG. 3 is a detailed view of FIG. 2.
Figure 4:
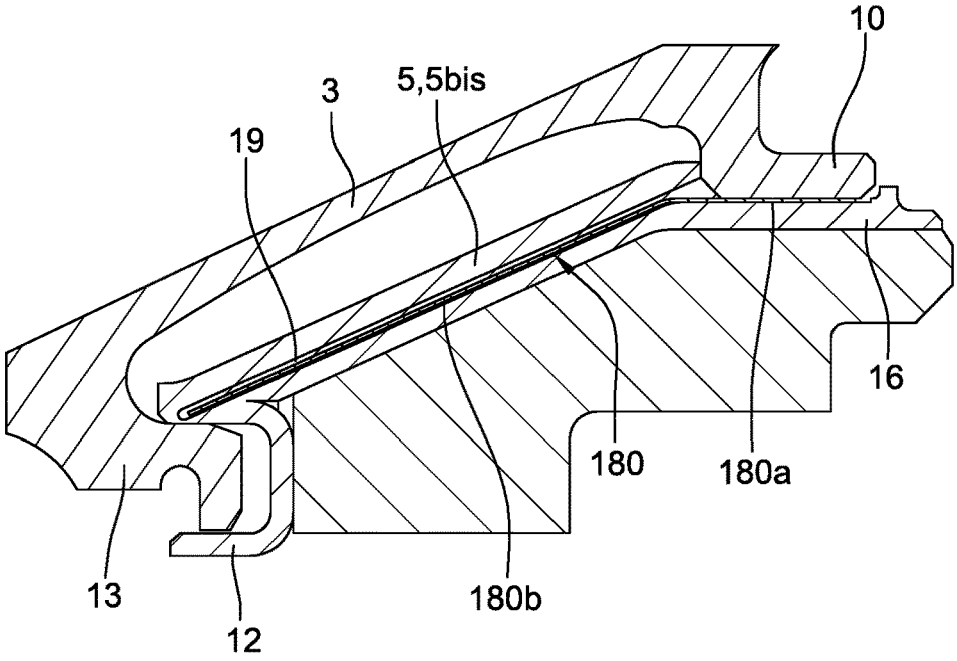
FIG. 4 is a sectional view of the turbine stage proposed by the present application.

As illustrated in FIG. 2 and in FIG. 3, flat plate 18 substantially rectangular in section is mounted half in a recess 19 of a circumferential edge of the ring sector and half in a recess 19 of a circumferential edge circumferentially opposite a circumferentially adjacent ring sector. More specifically, the recess 19 is formed in a frustoconical wall sector 15 of a ring sector 5*bis*, with the upstream end of the recess 19 opening in the downstream face of the annular groove sector 14 so as to allow installation of the sealing plate 18 from the downstream direction.

During operation, frictions between the downstream ends of the sealing plate 18 and the downstream rail 10 of the external casing 3, result in wear of the respective parts in contact with one another. The friction area is illustrated by inset I in FIG. 3.

In order to overcome these wear phenomena, it is proposed to use a plate 180 which is a component made in one piece, comprising two flat portions forming an angle with each other. More specifically, this plate 180 comprises, in the state installed on the turbine, an axial end portion 180*a* extending in the annular groove 14 and an upstream portion 180*b* engaged in two recesses 19 opposite two adjacent ring sectors 5*bis*. The downstream axial end portion 180*a* is arranged radially between the circumferential rail 10 and two adjacent ring sectors 5*bis*, as illustrated in FIGS. 4 to 8.

This configuration not only allows an increase in the degree of sealing between the ring and the casing rail, but also elimination of the frictions between the sealing members and the casing rail.

Figure 5:
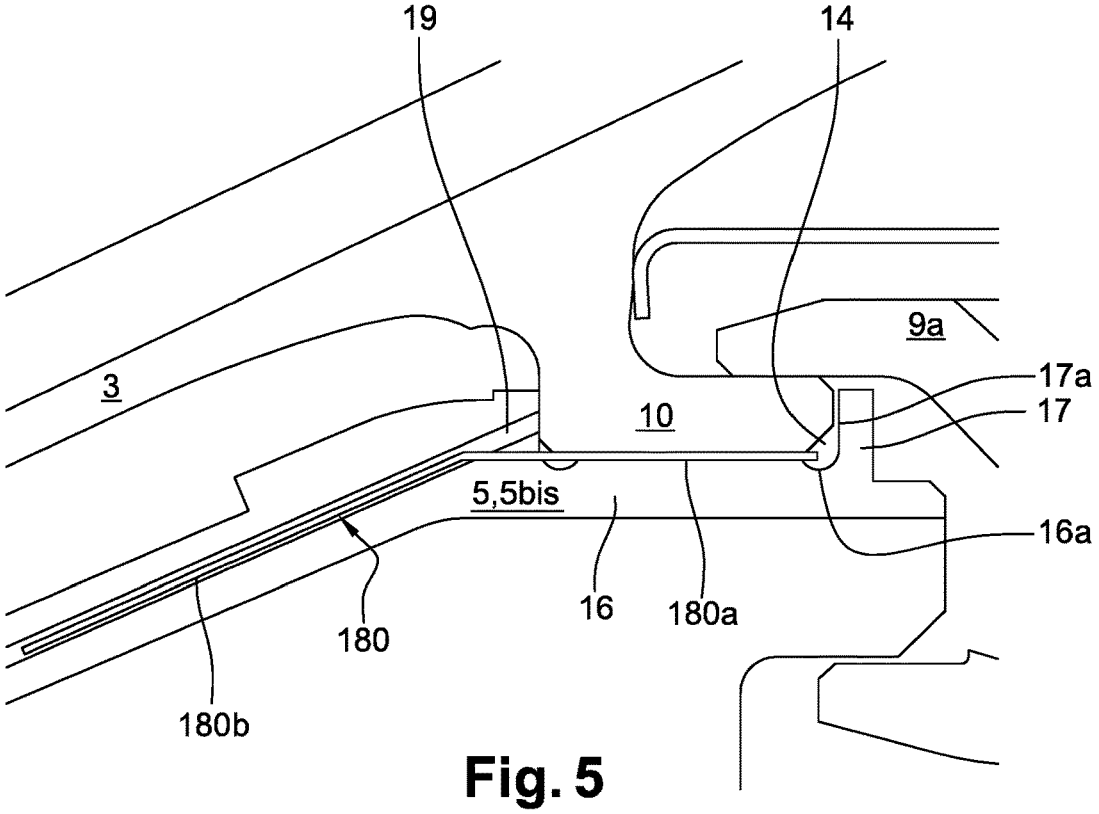
FIG. 5 is a diagrammatic view of the invention.
Figure 6:
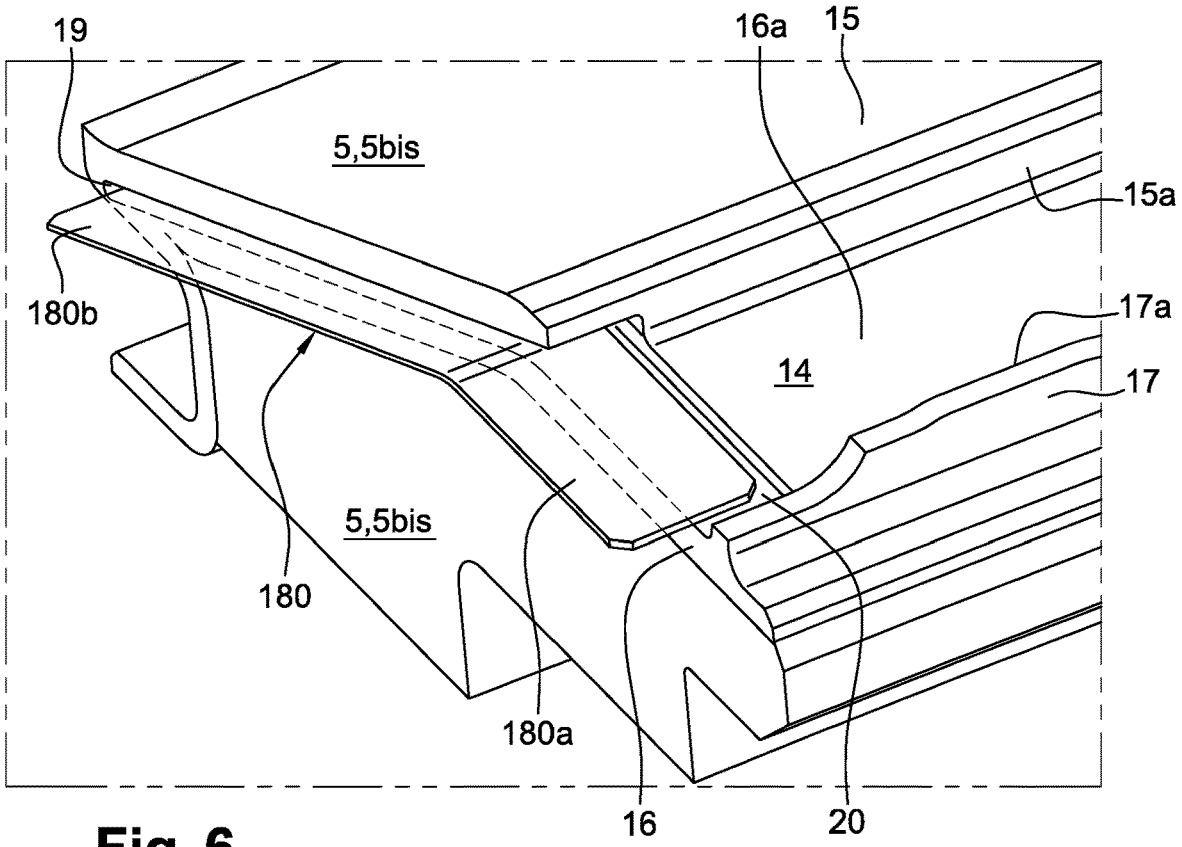
FIG. 6 is a perspective view of a ring sector.

FIG. 5 illustrates positioning of the axial end portion 180*a* of the plate 180 between the circumferential rail and the adjacent ring sectors 5*bis*. The axial end portion 180*a* of the plate 180 can be elastically stressed between the circumferential rail 10 and two adjacent ring sectors 5*bis*.

This stress advantageously allows reduction in play between the casing rail and the ring, which allows an even greater reduction in the vibrations and wear in this area.

Figure 7:
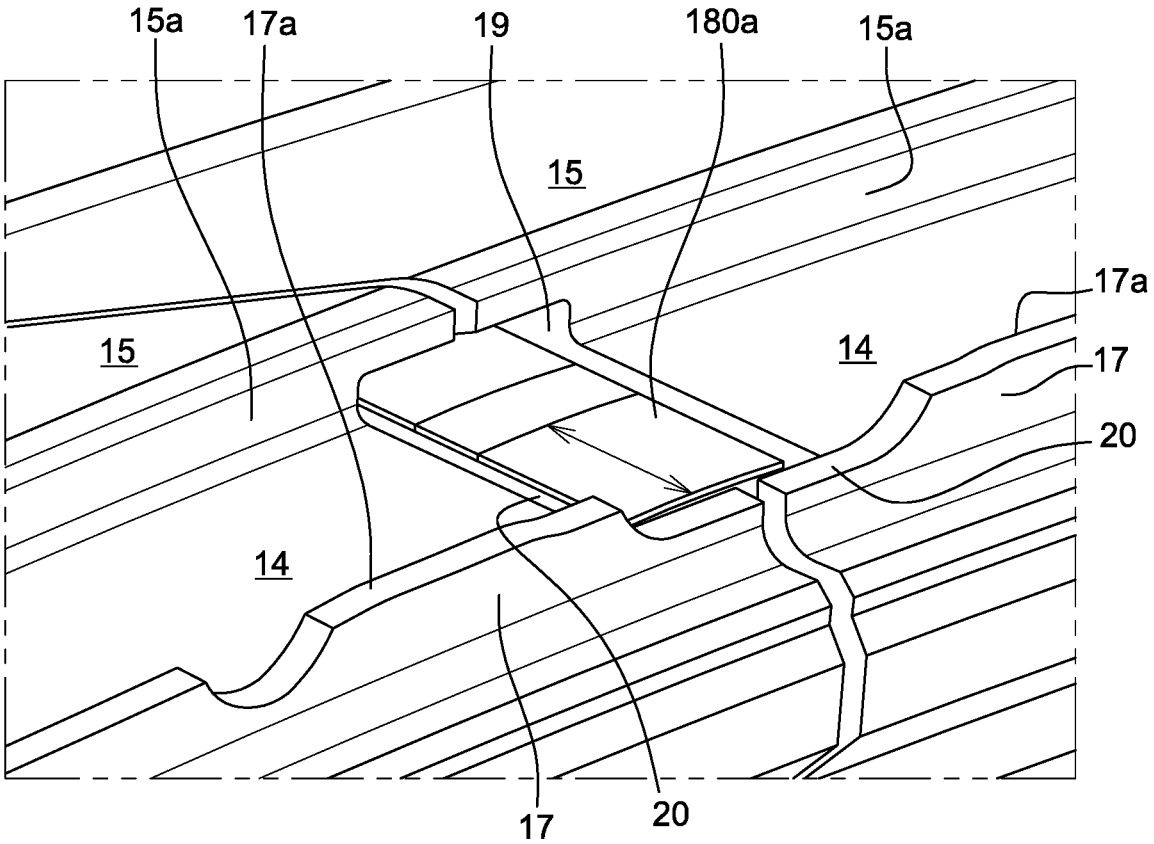
FIG. 7 is a perspective view of two adjacent ring sectors.
Figure 8:
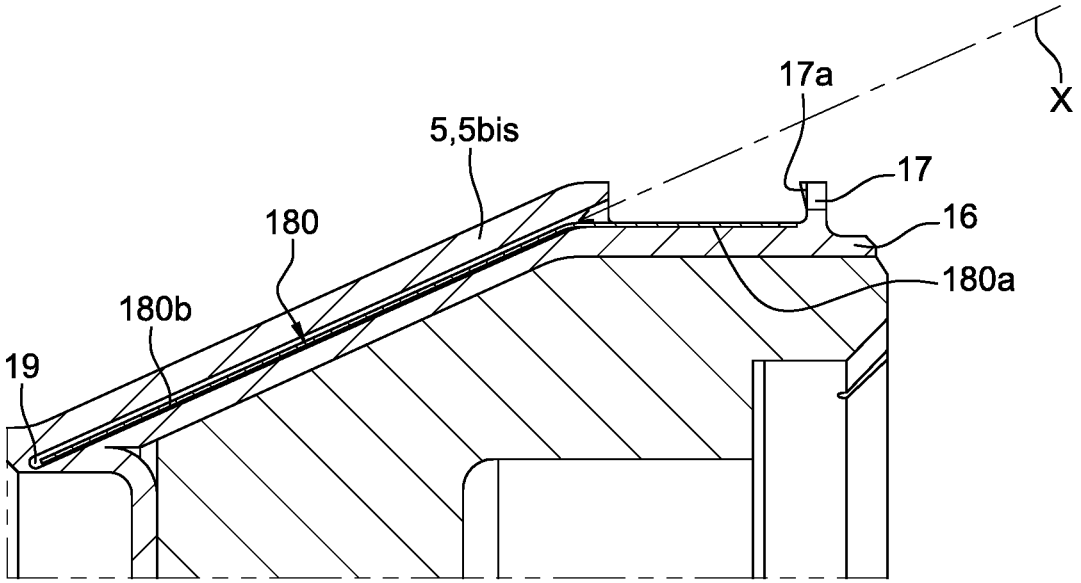
FIG. 8 is a side view of a ring sector.

Two circumferentially adjacent ring sectors 5*bis* are illustrated in FIG. 7. The recess 19 of each circumferential edge of each ring sector 5*bis* is formed by a slot opening axially in the annular groove 14 of the ring. This facilitates installation of the plate in the recess 19. The installation axis of the plate in this slot is represented and marked X in FIG. 8.

Furthermore, as illustrated in FIG. 7, each annular groove sector 14 of a ring sector 5*bis* comprises a bottom wall, the circumferential end portions of which each comprise a depression 20, defining with a circumferentially adjacent depression 20 of a circumferential end portion of a circumferentially adjacent ring sector 5*bis* an area for receiving said axial end portion 180*a* of the plate 180.

Figure 9:
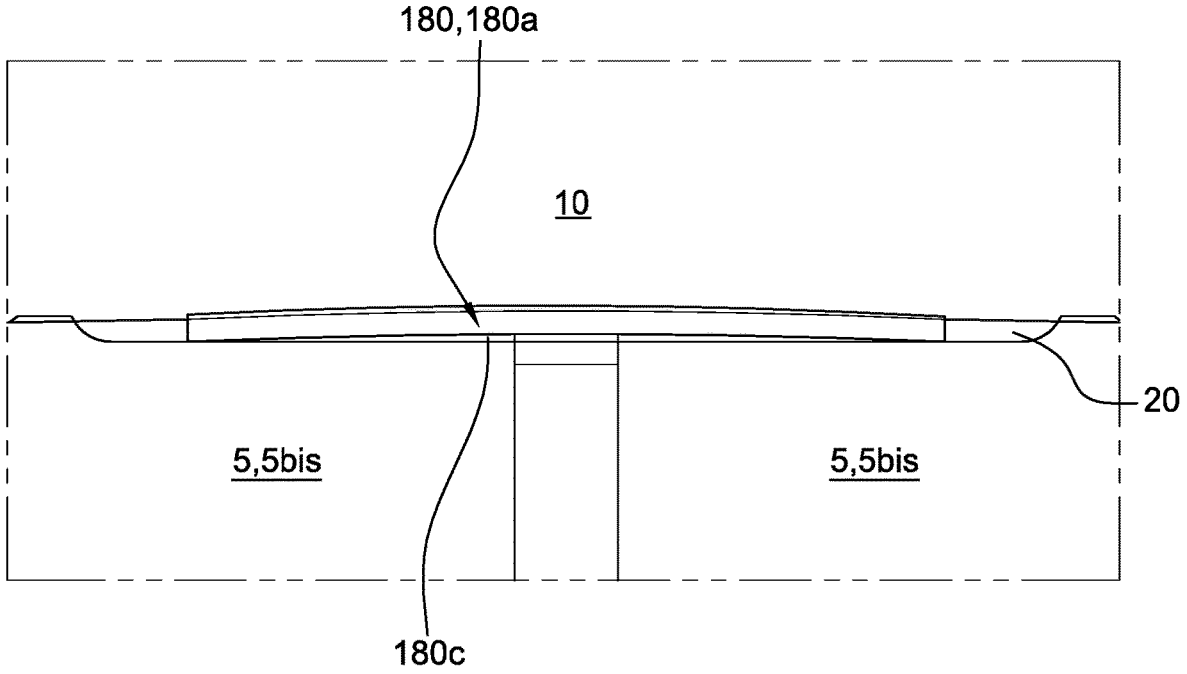
FIG. 9 is a detailed sectional view of FIG. 7.

As illustrated in FIG. 9, the axial end portion 180*a* of the plate 180 may be advantageously curved in the circumferential direction such that its radially internal face 180*c* is concave.

Consequently, contact between the circumferential rail 10 and the plate 180 is homogeneous. This new type of contact between the circumferential rail 10 and the plate 180 is more stable than that of the prior art. Shifting the contact area in the downstream direction makes it possible to repair the casing rail 10 using known machining methods.

The plate 180 advantageously has a thickness or radial dimension smaller than the radial dimension of the receiving area.

According to a preferred embodiment, this thickness is between 0.1 and 0.5 mm.

Secondly, a turbine is proposed, comprising a stage as described above. Thus, the rail 10 of the casing 3 of this turbine is rendered repairable, which extends even more the service life of such a turbine.

Finally, a turbine engine, such as a turboprop engine or a turbojet engine, comprising such a turbine is proposed.

The invention claimed is:

1. A sealing assembly for a turbine engine, comprising: a first and second adjacent ring sector (5, 5*bis*) in the circumferential direction configured to carry an abradable material, wherein axial ends of each first and second ring sectors (5, 5*bis*) comprise a groove (14, 14*bis*) in which a circumferential portion of a casing (10) is engaged with a sealing member (180) being partly engaged in a recess (19) of the first ring sector (5), and another part thereof being engaged in a recess (19*bis*) of the second ring sector (5*bis*), the recess (19) and groove (4) of the first ring sector (5) being respectively arranged circumferentially opposite the recess (19*bis*) and the groove (4*bis*) of the second ring sector (5*bis*), characterised in that the sealing member (180) comprises an axial end portion (180*a*) arranged radially between the circumferential portion of the casing (10) and the respective grooves (14, 14*bis*) of the first and second ring sectors (5, 5*bis*).

2. The sealing assembly according to claim 1, wherein said axial end portion (180*a*) of the sealing member (180) may be elastically stressed between the circumferential casing portion (10) and the adjacent first and second ring sectors (5*bis*).

3. The sealing assembly according to claim 2, wherein the recess (19) of each of the first and second ring sectors (5, 5*bis*) is formed by a slot opening axially, respectively, in the groove (14) of the first and second ring sectors (5, 5*bis*).

4. The sealing assembly according to claim 3, wherein the sealing member (180) is formed by a plate, said axial end portion (180*a*) of which is curved in the circumferential direction such that its radially internal face (180*c*) is concave.

5. The sealing assembly according to claim 4, wherein the groove (14, 14*bis*) of each of the first and second ring sectors (5, 5*bis*) comprise a bottom wall, the circumferential end portions of which each comprise a depression (20), these depressions being circumferentially opposite each other and jointly defining an area for receiving said axial end portion (180*a*) of a sealing member (180).

6. The sealing assembly according to claim 3, wherein the groove (14, 14*bis*) of each of the first and second ring sectors (5, 5*bis*) comprise a bottom wall, the circumferential end portions of which each comprise a depression (20), these depressions being circumferentially opposite each other and jointly defining an area for receiving said axial end portion (180*a*) of a sealing member (180).

7. The sealing assembly according to claim 2, wherein the sealing member (180) is formed by a plate, said axial end portion (180*a*) of which is curved in the circumferential direction such that its radially internal face (180*c*) is concave.

8. The sealing assembly according to claim 7, wherein the groove (14, 14*bis*) of each of the first and second ring sectors (5, 5*bis*) comprise a bottom wall, the circumferential end portions of which each comprise a depression (20), these depressions being circumferentially opposite each other and jointly defining an area for receiving said axial end portion (180*a*) of a sealing member (180).

9. The sealing assembly according to claim 2, wherein the groove (14, 14*bis*) of each of the first and second ring sectors (5, 5*bis*) comprise a bottom wall, the circumferential end portions of which each comprise a depression (20), these depressions being circumferentially opposite each other and jointly defining an area for receiving said axial end portion (180*a*) of a sealing member (180).

10. The sealing assembly according to claim 1, wherein the recess (19) of each of the first and second ring sectors (5, 5*bis*) is formed by a slot opening axially, respectively, in the groove (14) of the first and second ring sectors (5, 5*bis*).

11. The sealing assembly according to claim 10, wherein the sealing member (180) is formed by a plate, said axial end portion (180*a*) of which is curved in the circumferential direction such that its radially internal face (180*c*) is concave.

12. The sealing assembly according to claim 11, wherein the groove (14, 14*bis*) of each of the first and second ring sectors (5, 5*bis*) comprise a bottom wall, the circumferential end portions of which each comprise a depression (20), these depressions being circumferentially opposite each other and jointly defining an area for receiving said axial end portion (180*a*) of a sealing member (180).

13. The sealing assembly according to claim 10, wherein the groove (14, 14*bis*) of each of the first and second ring sectors (5, 5*bis*) comprise a bottom wall, the circumferential end portions of which each comprise a depression (20), these depressions being circumferentially opposite each other and jointly defining an area for receiving said axial end portion (180*a*) of a sealing member (180).

14. The sealing assembly according to claim 1, wherein the sealing member (180) is formed by a plate, said axial end portion (180*a*) of which is curved in the circumferential direction such that its radially internal face (180*c*) is concave.

15. The sealing assembly according to claim 14, wherein the groove (14, 14*bis*) of each of the first and second ring sectors (5, 5*bis*) comprise a bottom wall, the circumferential end portions of which each comprise a depression (20), these depressions being circumferentially opposite each other and jointly defining an area for receiving said axial end portion (180*a*) of a sealing member (180).

16. The sealing assembly according to claim 1, wherein the groove (14, 14*bis*) of each of the first and second ring sectors (5, 5*bis*) comprise a bottom wall, the circumferential end portions of which each comprise a depression (20), these depressions being circumferentially opposite each other and jointly defining an area for receiving said axial end portion (180*a*) of a sealing member (180).

17. The sealing assembly according to claim 16, wherein the sealing member (180) has a thickness or radial dimension smaller than the radial dimension of the receiving area.

18. A turbine engine comprising an assembly according to claim 1.

19. The turbine engine according to claim 18, wherein the turbine engine is a turbojet or a turboprop.

* * * * *